US012560322B2

(12) United States Patent
Mangin et al.

(10) Patent No.: US 12,560,322 B2
(45) Date of Patent: Feb. 24, 2026

(54) EXHAUST PLUME CONTROL STRUCTURE AND POWER GENERATING PLANT INCLUDING SAME

(71) Applicant: General Electric Company, Schenectady, NY (US)

(72) Inventors: Etienne Marie Luc Mangin, Belfort (FR); Laxmikant Merchant, Bengaluru (IN)

(73) Assignee: General Electric Company, Schenectady, NY (US)

( * ) Notice: Subject to any disclaimer, the term of this patent is extended or adjusted under 35 U.S.C. 154(b) by 645 days.

(21) Appl. No.: 18/047,745

(22) Filed: Oct. 19, 2022

(65) Prior Publication Data

US 2023/0243500 A1 Aug. 3, 2023

(30) Foreign Application Priority Data

Feb. 3, 2022 (EP) ..... 22154937

(51) Int. Cl.
*F23J 13/02* (2006.01)
*F23J 13/08* (2006.01)

(52) U.S. Cl.
CPC ..... *F23J 13/02* (2013.01); *F23J 13/08* (2013.01); *F23J 2900/15004* (2013.01)

(58) Field of Classification Search
CPC ... F23L 17/02; F23J 2900/15004; F23J 13/08; F23J 13/02

(Continued)

(56) References Cited

U.S. PATENT DOCUMENTS 16,246 A 12/1856 Mihan
915,871 A 3/1909 Merrill
(Continued)

FOREIGN PATENT DOCUMENTS

CH 492933 A 6/1970
CN 113294215 A 8/2021
(Continued)

OTHER PUBLICATIONS

European Search Report issued in connection with corresponding EP application No. 21155643.6, dated Jun. 25, 2021, 7 pages.
(Continued)

*Primary Examiner* — Vivek K Shirsat
(74) *Attorney, Agent, or Firm* — James Pemrick; Charlotte Wilson; Hoffman Warnick LLC

(57) ABSTRACT

An exhaust plume control structure includes a mounting member configured to mount to an exhaust flow source. A diverter member is coupled to the mounting member to radially direct an initial exhaust flow exiting from the exhaust flow source radially outward. A plurality of peripherally spaced, radially extending vanes are coupled to the mounting member and radially outward of the diverter member to separate the radially outward directed initial exhaust flow into a plurality of additional exhaust flows. Each vane has a radially diverging cross-section. Each of the plurality of additional exhaust flows has a same radial exit velocity. The structure reduces exhaust flow velocity and may provide back pressure to the initial exhaust flow. The structure has a sound power level of less than 115 dBA. A power generating plant including the structure is also disclosed.

20 Claims, 6 Drawing Sheets

(58) Field of Classification Search
USPC ..... 454/35, 38, 27
See application file for complete search history.

(56) References Cited

U.S. PATENT DOCUMENTS

| | | | | |
|---|---|---|---|---|
| 1,996,098 | A | 4/1935 | Chase | |
| 2,269,050 | A | 1/1942 | Zimmerman | |
| 2,396,746 | A * | 3/1946 | O'Day | F23L 17/02 454/34 |
| 3,012,495 | A | 12/1961 | Miller | |
| 3,477,358 | A * | 11/1969 | Howard | F23L 17/02 454/275 |
| 3,899,553 | A | 8/1975 | Furlong et al. | |
| 5,632,143 | A | 5/1997 | Fisher et al. | |
| 7,682,232 | B2 | 3/2010 | Howard | |
| 7,713,114 | B1 | 5/2010 | Paynton et al. | |
| 9,057,519 | B1 | 6/2015 | Paynton et al. | |
| 2008/0070491 | A1 | 3/2008 | Howard | |
| 2010/0242460 | A1 * | 9/2010 | Sponsky | F01N 13/20 60/320 |

FOREIGN PATENT DOCUMENTS

| | | | |
|---|---|---|---|
| DE | 102010045551 | A1 | 5/2012 |
| EP | 1185779 | B2 | 9/2016 |
| EP | 3869019 | A1 | 8/2021 |
| KR | 20050033605 | A | 4/2005 |
| WO | 2009078845 | A1 | 6/2009 |

OTHER PUBLICATIONS

European Search Report issued in connection with corresponding EP application No. 22154937.1, dated Jul. 4, 2022, 7 pages.

* cited by examiner

EXHAUST PLUME CONTROL STRUCTURE AND POWER GENERATING PLANT INCLUDING SAME

BACKGROUND

The disclosure relates generally to industrial machine exhaust plume control and, more particularly, to an exhaust plume control structure for an exhaust plume in, for example, a power generating plant.

A wide variety of industrial machines create exhaust that is distributed to the atmosphere. For example, ground-based power generating systems create exhaust that is directed into the atmosphere by a stack, i.e., a chimney, that directs and cools the exhaust prior to allowing it to escape to the environment. Certain agencies may promulgate environmental or safety laws and/or regulations that present operational limitations relative to a system's exhaust plume. For example, where a power generating system is located near an airport, government laws or regulations may limit exhaust stack plume velocity at lower altitudes for safety purposes. The Australian Civil Aviation Safety Authority (CASA), for example, requires exhaust stack plume velocity to be less than 6.1 meters/second (m/s) at an altitude of 198 meters. Mechanisms to control exhaust stack plume velocity typically require controlling upstream, internal operating parameters that negatively impact the power generating system's performance. Exhaust plume control systems that include several divider members may generate too much noise, thus violating noise regulations for certain locations.

BRIEF DESCRIPTION

All aspects, examples and features mentioned below can be combined in any technically possible way.

An aspect of the disclosure provides an exhaust plume control structure, comprising: a mounting member configured to mount to an exhaust flow source; a cover member spaced from the mounting member; a diverter member operatively coupled to the mounting member to radially direct an initial exhaust flow exiting from the exhaust flow source radially outward; a plurality of peripherally spaced, radially extending vanes coupled to the mounting member and disposed radially outward of the diverter member, the plurality of peripherally spaced vanes positioned to separate the radially outward directed initial exhaust flow into a plurality of additional exhaust flows, each vane of the plurality of peripherally spaced vanes having a radially diverging cross-section.

Another aspect of the disclosure includes any of the preceding aspects, and the mounting member includes a plate having an opening defined therein in fluid communication with the exhaust flow source, wherein the diverter member extends into or toward the opening to radially direct the initial exhaust flow from the exhaust flow source across each of the plurality of peripherally spaced vanes.

Another aspect of the disclosure includes any of the preceding aspects, and the diverter member includes at least a section of a cone, the at least a section of the cone extending into or toward the opening, wherein an outer surface of the diverter member is positioned in a spaced relation relative to an inner edge of the opening.

Another aspect of the disclosure includes any of the preceding aspects, and the at least the section of the cone includes a frustoconical member.

Another aspect of the disclosure includes any of the preceding aspects, and the diverter member further includes a cover member enclosing an axial end thereof.

Another aspect of the disclosure includes any of the preceding aspects, and the radially diverging cross-section of each of the plurality of peripherally spaced vanes defines an isosceles triangle centered on a radius of the diverter member.

Another aspect of the disclosure includes any of the preceding aspects, and the radially diverging cross-section of each of the plurality of peripherally spaced vanes defines an equilateral triangle centered on the radius of the diverter member.

Another aspect of the disclosure includes any of the preceding aspects, and a radially outer end of the plurality of peripherally spaced vanes collectively block a circumferential opening between the diverter member and the mounting member by 25-45%.

Another aspect of the disclosure includes any of the preceding aspects, and the mounting member includes a base member having an opening therein, a flow expansion member coupled to the base member, and a mounting extension extending from the flow expansion member, the mounting extension configured for coupling to the exhaust flow source.

Another aspect of the disclosure includes any of the preceding aspects, and the exhaust flow source includes an exhaust stack of a power generating plant.

An aspect of the disclosure provides a power generating plant, including: a power generating system, the power generating system creating an initial exhaust flow; a stack configured to direct the initial exhaust flow to the atmosphere; and an exhaust plume control structure, including: a mounting member configured to mount to the stack; a cover member spaced from the mounting member; a diverter member operatively coupled to the mounting member to radially direct an initial exhaust flow exiting from the exhaust flow source radially outward; a plurality of peripherally spaced, radially extending vanes coupled to the mounting member and disposed radially outward of the diverter member, the plurality of peripherally spaced vanes positioned to separate the radially outward directed initial exhaust flow into a plurality of additional exhaust flows, each vane of the plurality of peripherally spaced vanes having a radially diverging cross-section, each of the plurality of additional exhaust flows having a same radial exit velocity.

Another aspect of the disclosure includes any of the preceding aspects, and the mounting member includes a plate having an opening defined therein in fluid communication with the exhaust flow source, wherein the diverter member extends into or towards the opening to radially direct the initial exhaust flow from the exhaust flow source across each of the plurality of peripherally spaced vanes.

Another aspect of the disclosure includes any of the preceding aspects, and the diverter member includes at least a section of a cone, the at least a section of the cone extending into or toward the opening, wherein an outer surface of the diverter member is positioned in a spaced relation relative to an inner edge of the opening.

Another aspect of the disclosure includes any of the preceding aspects, and the at least the section of the cone includes a frustoconical member.

Another aspect of the disclosure includes any of the preceding aspects, and the plurality of peripherally spaced vanes includes twelve vanes.

Another aspect of the disclosure includes any of the preceding aspects, and the radially diverging cross-section of each of the plurality of peripherally spaced vanes defines an isosceles triangle centered on a radius of the diverter member.

Another aspect of the disclosure includes any of the preceding aspects, and the radially diverging cross-section of each of the plurality of peripherally spaced vanes defines an equilateral triangle centered on the radius of the diverter member.

Another aspect of the disclosure includes any of the preceding aspects, and a radially outer end of the plurality of peripherally spaced vanes collectively block a circumferential opening between the diverter member and the mounting member by 25-45%.

Another aspect of the disclosure includes any of the preceding aspects, and the mounting member includes a base member having an opening therein, a flow expansion member coupled to the base member, and a mounting extension extending from the flow expansion member, the mounting extension configured for coupling to the exhaust flow source.

Another aspect of the disclosure includes any of the preceding aspects, and the diverter member further includes a cover member enclosing an axial end thereof.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
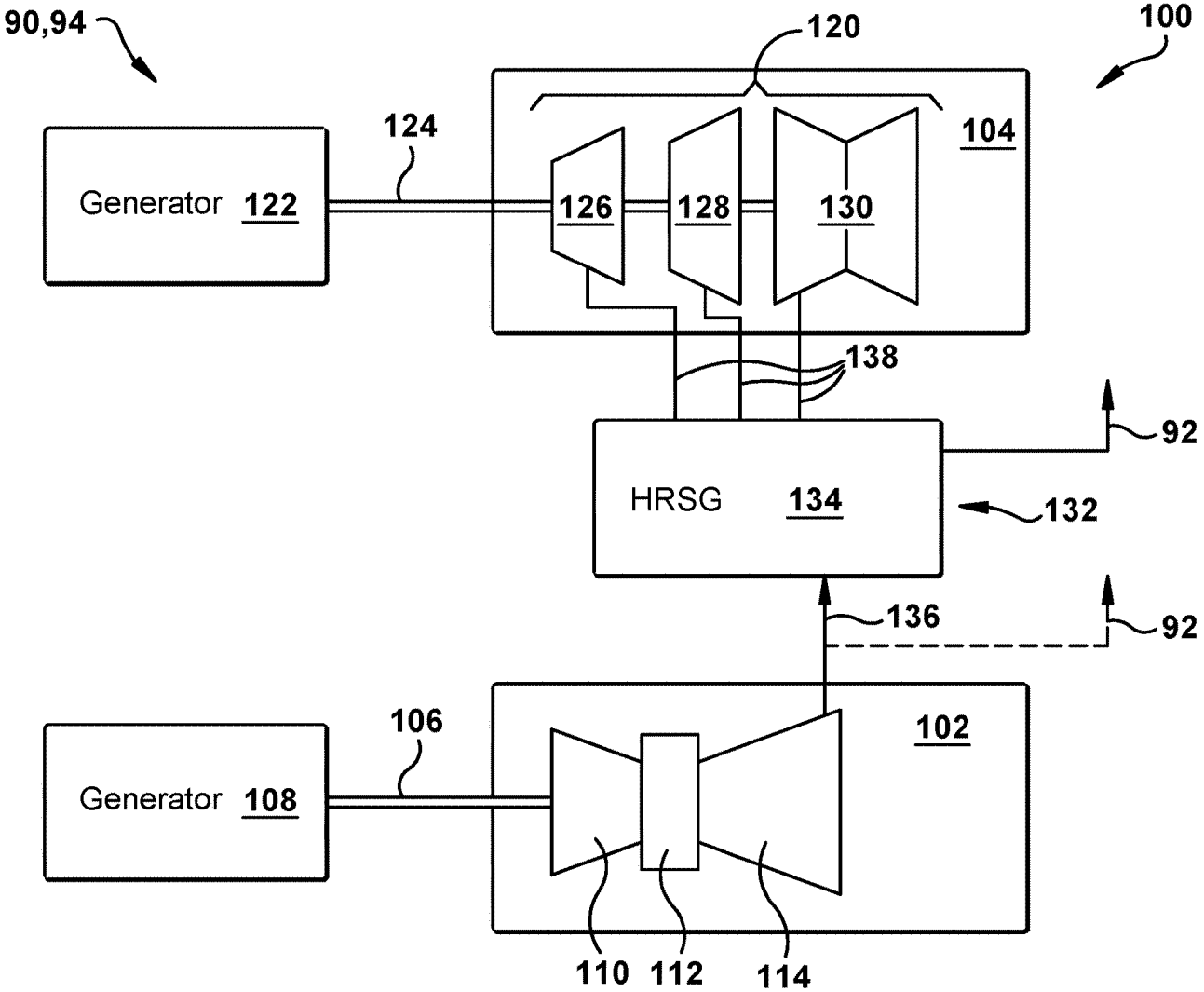
FIG. 1 shows a schematic view of an illustrative industrial machine in which an exhaust plume control structure according to embodiments of the disclosure may be employed.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the current technology, it will become necessary to select certain terminology when referring to and describing relevant machine components within an industrial machine. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as an exhaust flow from an exhaust flow source, e.g., an exhaust stack. The term "downstream" corresponds to the direction of flow of the fluid, and the term "upstream" refers to the direction opposite to the flow (i.e., the direction from which the flow originates).

It is often required to describe parts that are disposed at differing radial positions with regard to a center axis. The term "radial" refers to movement or position perpendicular to an axis. For example, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. A "radius" is an imaginary line that extends from the center of the axis radially outward that may be used as a reference. The term "axial" refers to movement or position parallel to the axis. Finally, the term "circumferential" refers to movement or position around the axis. In this disclosure, it will be appreciated that such terms may be applied in relation to a center axis of an exhaust flow source, e.g., a stack.

In addition, several descriptive terms may be used regularly herein, as described below. The terms "first," "second," and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there are no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, the disclosure provides an exhaust plume control structure. The structure may include a mounting member configured to mount to an exhaust flow source such as a stack (smokestack) of an industrial machine that creates exhaust. A cover member is axially spaced from the mounting member relative to the flow of exhaust through the stack, and a diverter member is coupled to the cover member to direct an initial exhaust flow exiting from the exhaust flow source radially outward. A plurality of peripherally spaced, radially extending vanes are positioned between the mounting member and the cover member to separate the radially outward directed initial exhaust flow into a plurality of additional exhaust flows. Each vane has a radially diverging cross-section, which collectively reduces noise of the exhaust exiting the structure. Each of the plurality of additional exhaust flows has the same radial exit velocity. The structure reduces overall exhaust flow velocity and may provide back pressure to the initial exhaust flow. Each of the additional exhaust flows has a slower velocity than the initial exhaust flow. In one non-limiting example, the structure has a sound power level of less than 115 A-weighted decibels (dBA). A power generating plant including the structure is also disclosed.

Turning to FIG. 1, a schematic view of portions of an illustrative industrial machine 90 that generates an initial exhaust flow 92, e.g., via a combustion reaction, is illustrated. The disclosure will be described relative to a power generating plant 94. It is emphasized and will be apparent that the teachings of the disclosure are applicable to any industrial machine 90 that generates initial exhaust flow 92, e.g., any combustion system. Power generating plant 94 can take any now known or later developed form. In one example, the power generating plant 94 may include a power generating system 100 in the form of a combined cycle power plant (CCPP), as shown in FIG. 1, but which can also operate as a simple cycle power plant (SCPP). In the instant example, the CCPP or SCPP is a multiple shaft system with two generators, although one with skill in the art will readily understand that the teachings of the disclosure are applicable to any variety of CCPPs or SCPPs. The CCPP or SCPP may include a gas turbine system 102 and a steam turbine system 104.

Gas turbine system 102 may be mechanically coupled by a shaft 106 to a first generator 108, which generates electrical energy. Gas turbine system 102 may include a compressor 110 and a combustor 112. Gas turbine system 102 also includes gas turbine 114 coupled to common compressor/turbine shaft 106. In one embodiment, gas turbine system 102 is a 9F.05 engine, commercially available from General Electric Company, Greenville, S.C. The present disclosure is not limited to any one particular GT system and may be implanted in connection with other engines including, for example, the other HA, F, B, LM, GT, TM and E-class engine models of General Electric Company and engine models of other companies.

In operation, air enters the inlet of compressor 110, is compressed and then discharged to combustor 112 where gaseous fuel (e.g., natural gas) and/or liquid fuel (e.g., oil) is burned to provide high energy combustion gases that drive gas turbine 114. In gas turbine 114, the energy of the hot gases is converted into work, some of which is used to drive compressor 110 through rotating shaft 106, with the remainder available for useful work to drive a load such as first generator 108 via shaft 106 for producing electricity.

Steam turbine system 104 includes a steam turbine 120 that is operably coupled to another generator 122 through shaft 124. Steam turbine system 104 may include one or more steam turbines, e.g., as shown, a high pressure (HP) turbine 126, an intermediate pressure (IP) turbine 128 and a low pressure (LP) turbine 130, each of which are coupled to shaft 124. Each steam turbine 126, 128, 130 includes a plurality of rotating blades (not shown) mechanically coupled to shaft 124.

The CCPP may also include a steam source 132, which may be a heat recovery steam generator (HRSG) 134 operably connected to gas turbine system 102 and steam turbine system 104. As understood, exhaust 136 from gas turbine system 102 is used by HRSG 134 to create steam flow(s) 138 for use by steam turbine system 104. HRSG 134 may include a conventional HRSG configuration, such as those used in conventional CCPPs, and/or may be embodied as another type of heat exchanger or similar component for using exhaust energy to produce steam.

In operation, steam from steam source 132 (e.g., HRSG 134 and perhaps other sources) enters an inlet of HP turbine 126, IP turbine 128 and/or LP turbine 130 and is channeled to impart a force on blades thereof causing shaft 124 to rotate. As understood, steam from an upstream (higher-pressure) turbine may be employed later in a downstream (lower-pressure) turbine. The steam thus produced by steam source 132 drives at least a part of steam turbine system 104 in which additional work is extracted to drive shaft 124 and an additional load such as second generator 122 which, in turn, produces additional electric power. It is understood that generators 108, 122 and shafts 106, 124 may be of any size or type known in the art and may differ depending upon their application or the system to which they are connected.

While power generating plant 94 has been described as having power generating system 100 as a CCPP, it is understood that power generating plant 94 may include power generating system 100 as a simple cycle power plant, e.g., including only GT system 102 creating initial exhaust flow 92 (in dashed lines). As understood in the field, exhaust from power generating system 100 may exit GT system 102 and/or HRSG 134 as initial exhaust flow 92.

Figure 2:
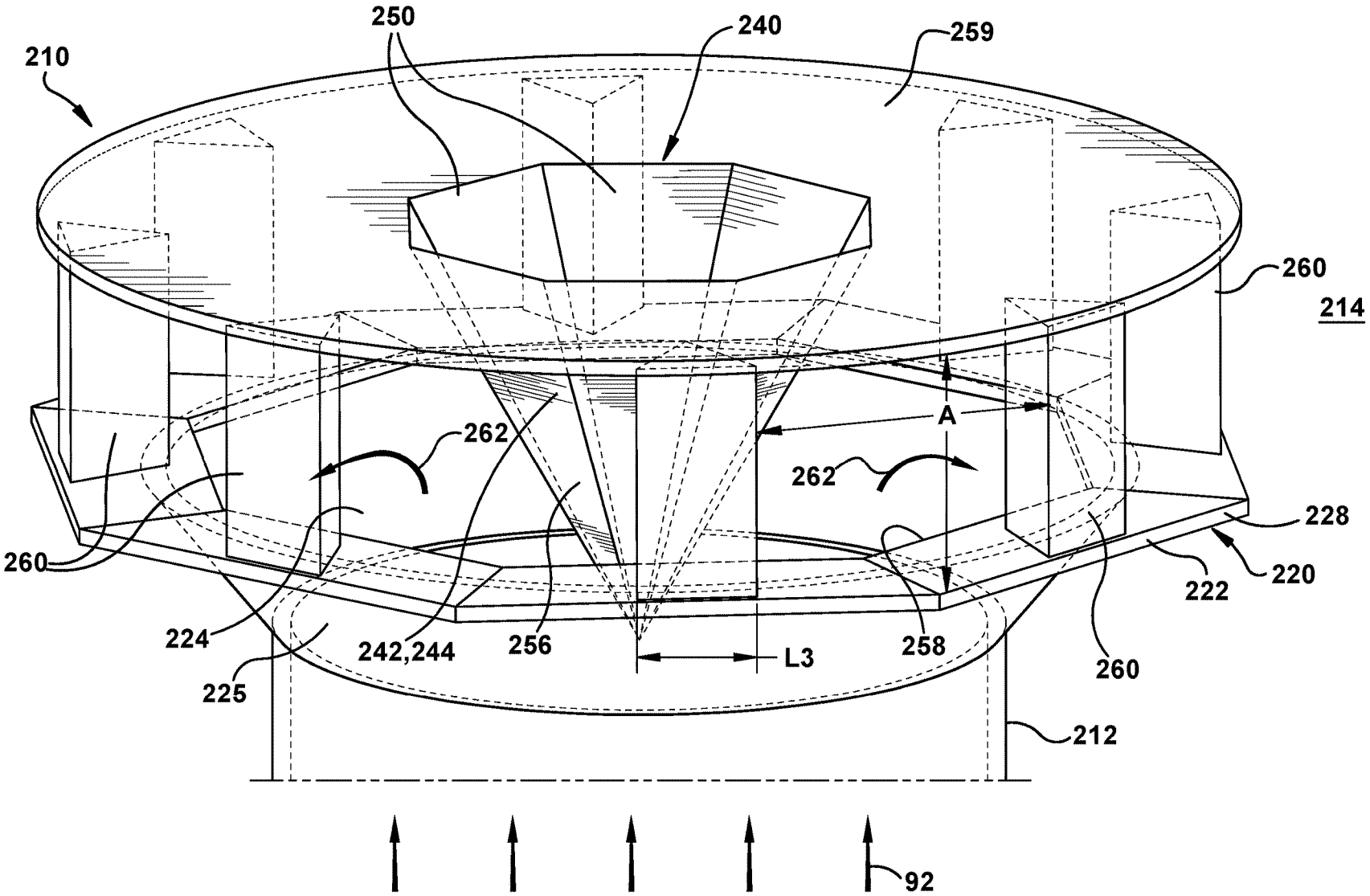
FIG. 2 shows a transparent perspective view of an exhaust plume control structure, according to embodiments of the disclosure.
Figure 3:
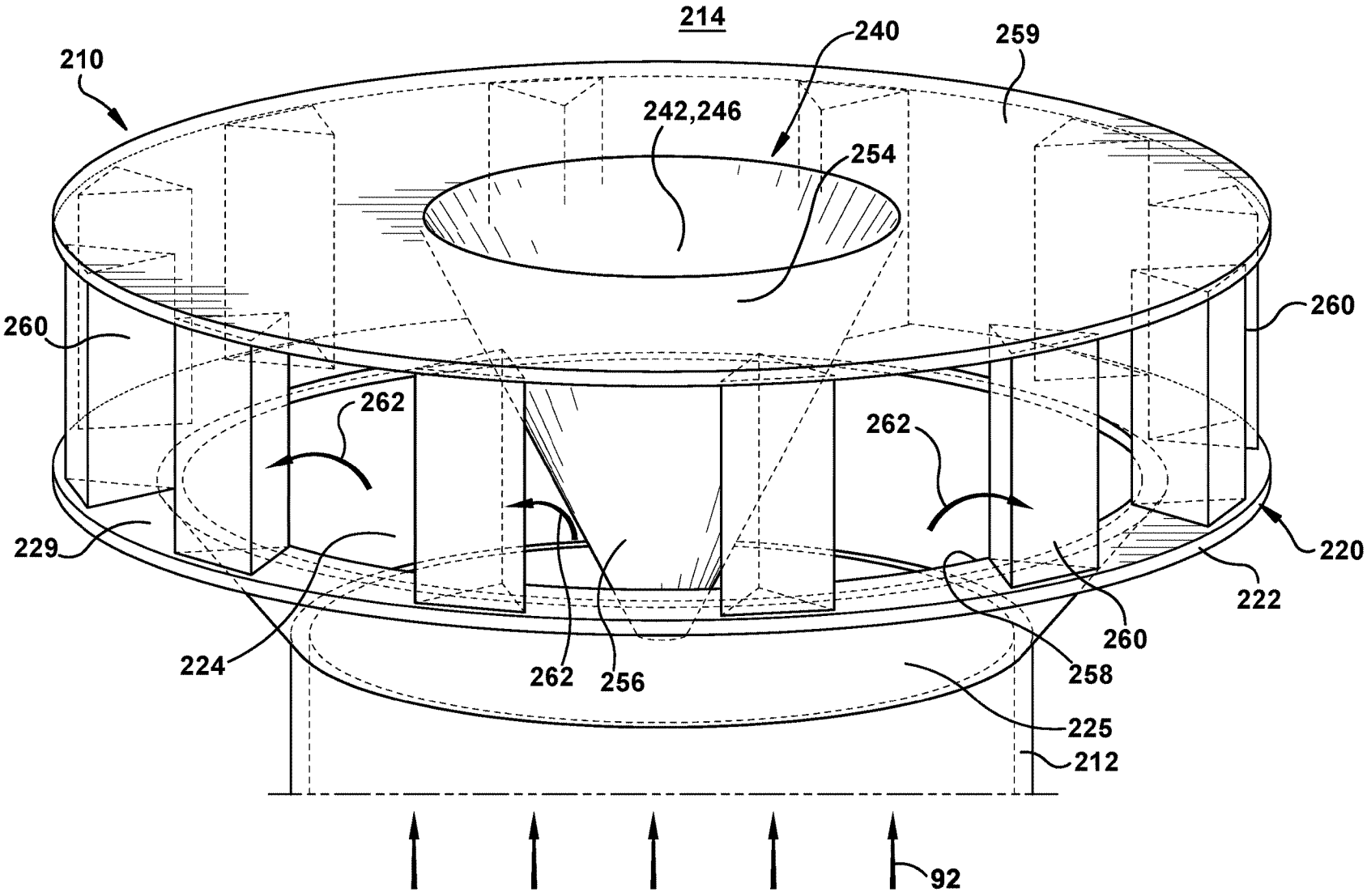
FIG. 3 shows a transparent perspective view of an exhaust plume control structure, according to embodiments of the disclosure.
Figure 4:
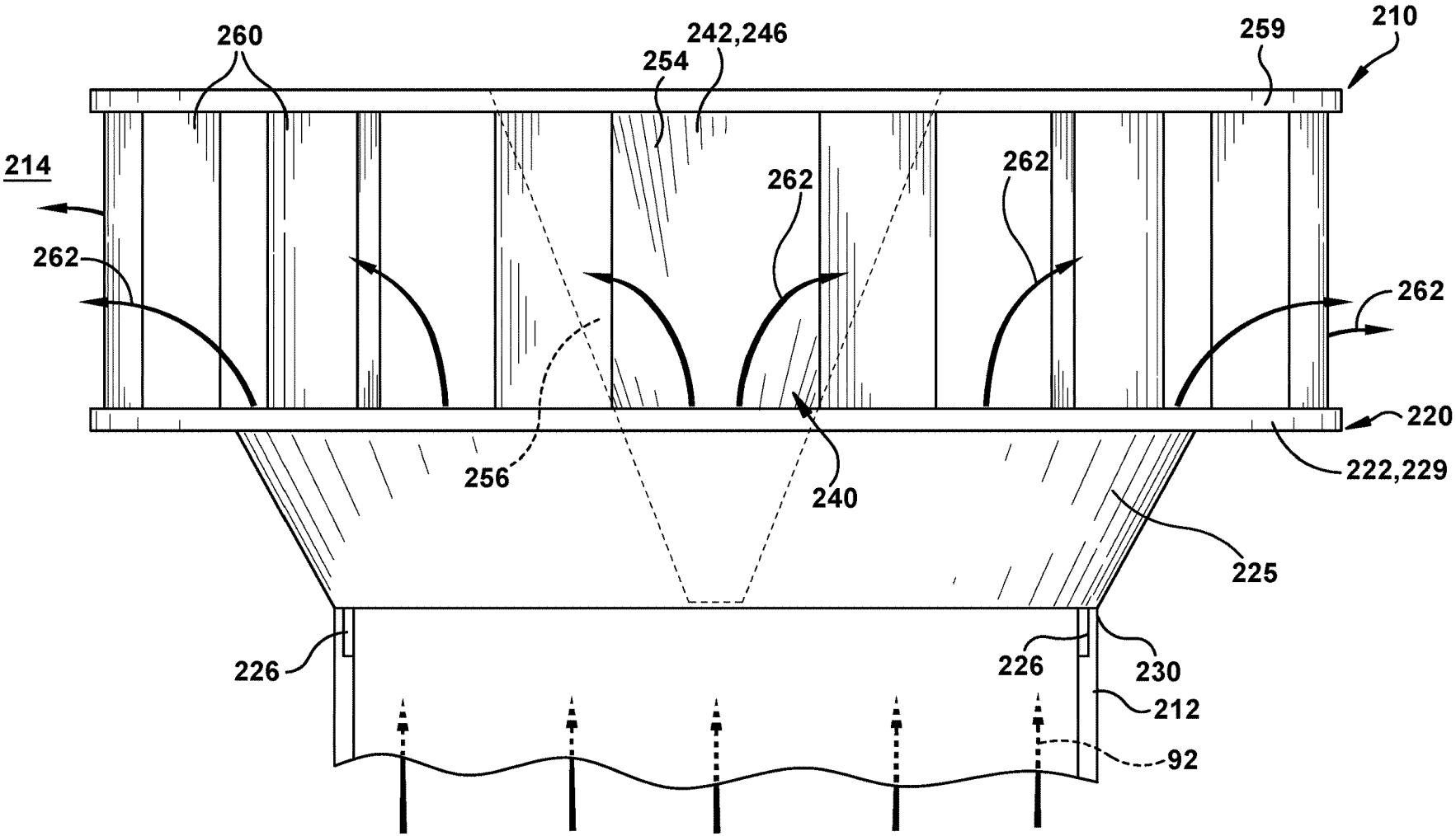
FIG. 4 shows a side, partial cross-sectional view of an exhaust plume control structure, according to embodiments of the disclosure.
Figure 7:
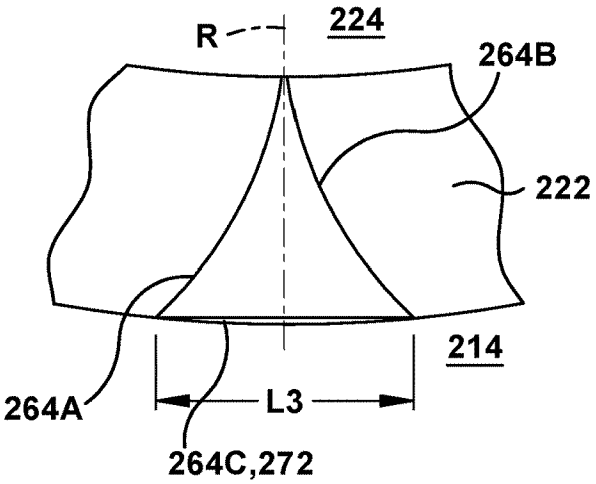
FIG. 7 shows a cross-sectional, top-down view of a vane, according to additional embodiments of the disclosure.

Referring to FIGS. 2-4, FIG. 2 shows a transparent perspective view, FIG. 3 shows a transparent perspective view, and FIG. 4 shows a side, partial cross-sectional view of an exhaust plume control structure 210, according to embodiments of the disclosure. As used herein, "exhaust plume" is any gas containing pollutants released from a point source, i.e., an exhaust flow source 212 such as a stack fluidly coupled to a combustion reaction in, for example, an industrial machine such as power generating plant 94 (FIG. 1). Exhaust flow source 212 may include any form of stack, i.e., a chimney or other conduit, directing and/or cooling initial exhaust flow 92, prior to allowing it to escape to atmosphere 214. As illustrated, initial exhaust flow 92 has an exit direction that is generally parallel to a longitudinal extent of exhaust flow source 212, e.g., substantially vertical. In one non-limiting example, initial exhaust flow 92 may have a relatively high temperature, e.g., >500° C. (° C.), and a relatively high exit velocity, e.g., >35 meters/second. Without structure 210, exhaust flow source 212 would emit initial exhaust flow 92 directly to atmosphere 214.

Exhaust plume control structure 210 (hereinafter "structure 210") may include a mounting member 220 configured to mount to exhaust flow source 212. As shown best in FIG. 3, mounting member 220 may include a base member 222 having an opening 224 therein and a flow expansion member 225 coupled to base member 222. Flow expansion member 225 may have a frusto-conical shape, allowing initial exhaust flow 92 to expand therein. Flow expansion member 225 may have other shapes and sizes and may be customized to impact and/or redirect initial exhaust flow 92, or portions thereof, in any desired manner. Flow expansion member 225 may include a single piece of material (shown), or multiple plate(s) coupled together (similar to, e.g., base member 222 and/or diverter member 240 in FIG. 2).

As shown in FIG. 4, mounting member 210 may also include a mounting extension 226 extending from flow expansion member 225. Mounting extension 226 is configured for coupling to exhaust flow source 212. To this end, mounting extension 226 may include any now known or later developed element to couple to an end 230 (FIG. 4) of exhaust flow source 212, i.e., depending on the form of end 230 of exhaust flow source 212. In one non-limiting example, exhaust flow source 212 may include a large pipe, e.g., of brick or steel, and end 230 may be an outlet end of the large pipe. In this example, as shown in FIG. 4, mounting extension 226 may include, for example, a collar configured to mate within or couple to end 230. Any form of fastener (not shown) may be used to secure mounting member 220 to exhaust flow source 212. Mounting member 220, and in particular flow expansion member 225, may be coupled to mounting extension 226 and may be configured to support the rest of structure 210 with base member 222. Base member 222 of mounting member 220 may include, for example, multiple interconnected plate pieces coupled to form a plate 228 (FIG. 2) with opening 224 defined therein, e.g., with a polygonal outer or inner edge. Alternatively, base member 222 may include a circular plate 229 (FIG. 3) that is a single piece of material or a number of sections coupled together. Opening 224 is in fluid communication with initial exhaust flow 92.

Structure 210 also includes a diverter member 240 operatively coupled to mounting member 220 to radially direct initial exhaust flow 92 exiting from exhaust flow source 212 radially outward, and eventually out of structure 210. Diverter member 240 gradually changes the direction of initial exhaust flow 92 from axial (e.g., vertical) to radial (e.g., horizontal). As illustrated in FIGS. 2-4, diverter member 240 extends into or towards opening 224 to radially direct initial exhaust flow 92 from exhaust flow source 212 across each of a plurality of peripherally spaced vanes 260. Diverter member 240 may include at least a section of a cone 242 extending into or toward opening 224. "At least a section of" cone 242 means a complete conical member (FIG. 2) or a frustoconical member (FIGS. 3-4). Diverter member 240 may have other shapes and sizes and may be customized to impact and/or redirect initial exhaust flow 92 or portions thereof, in any desired manner. FIG. 2 shows diverter member 240 in the form of a conical member 244 extending into opening 224, and FIGS. 3-4 show diverter member 240 in the form of a frustoconical member 246 extending toward opening 224, i.e., but not necessarily into opening 224 of base member 222.

Diverter member 240 may include, for example, a number of steel plate(s) 250 as shown in FIG. 2, or diverter member 240 may be a single piece of material 254 as shown in FIGS. 3-4. As illustrated, an outer surface 256 of diverter member 240 is positioned in a spaced relation relative to an inner edge 258 of opening 224 of base member 222 and flow expansion member 225. Initial exhaust flow 92 expands in flow expansion member 225 and passes through the spacing between diverter member 240 and inner edge 258 of base member 222. A diameter of outer surface 256 of diverter member 240 and/or that of an inner diameter of opening 224 and/or flow expansion member 225 may be selected to create a desired size spacing. As shown in FIG. 2, diverter member 240 may also include a cover member 259 enclosing an axial (outer) end thereof. Cover member 259, as shown in FIG. 3, may also provide an extension of section of cone 242 to position diverter member 240 relative to vanes 260.

Structure 210 also includes a plurality of peripherally spaced, radially extending vanes 260 (hereinafter "vanes 260") positioned between mounting member 220 and cover member 259. Vanes 260 are coupled to mounting member 220 (specifically, to base plate 228, 229) and are disposed radially outward of diverter member 240. The peripheral spacing between vanes 260 is typically uniform, but non-uniform spacing may be used. Vanes 260 support diverter member(s) 240 relative to mounting member 220 in a spaced, vertical relationship.

Vanes 260 are positioned to separate the radially outward directed initial exhaust flow 92 into a plurality of additional exhaust flows 262. Exhaust flows 262 may have a slower velocity than initial exhaust flow 92. However, each of the plurality of additional exhaust flows 262 has a same radial exit velocity, i.e., amongst themselves, to reduce noise. "Same radial exit velocity" indicates the exit radial exit velocity across area A between vanes 260 is within +/−5%. In one non-limiting example, an average radial exit velocity may be in a range of 80-90 meters/second (m/s), which provides good radial penetration after exiting structure 210 to prevent merging of the flows and which provides quality downstream mixing with ambient air, i.e., atmosphere 214. The radial exit velocity of each additional exhaust flow 262 is also substantially uniform about structure 210, and within each exit area A between vanes 260. The uniform radial exit velocities reduce noise. In one non-limiting example, the vertical velocity of exhaust flows 262 is significantly less than 6.1 meters/second (m/s) at an altitude of 198 meters (e.g., <1 m/s), which is within many government regulations.

Each vane 260 may have a radially diverging cross-section, i.e., as viewed in a top-down arrangement. Hence, vanes 260 extend vertically and radially relative to a center of structure 210. Vanes 260 also become increasingly larger as one moves farther radially outward from the center of structure 210. Vanes 260 extend partially circumferentially at their radial outer ends 272 (FIGS. 5-9). FIGS. 5-9 show cross-sectional top-down views of multiple vane 260 shapes. As shown in FIGS. 5-9, vanes 260 may include a number of plates 264 coupled together, e.g., steel plates welded together, to form a radially diverging cross-section.

Figure 6:
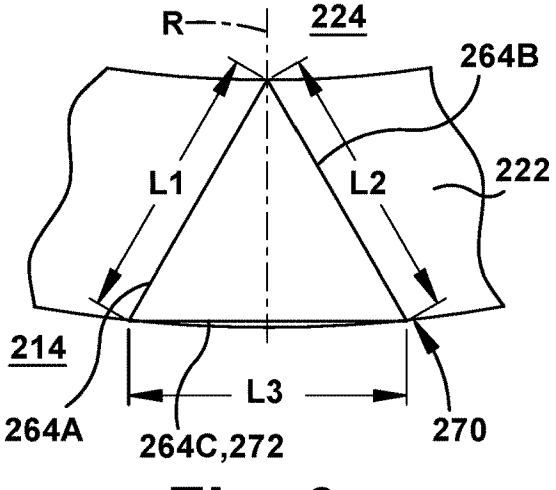
FIG. 6 shows a cross-sectional, top-down view of a vane, according to other embodiments of the disclosure.
Figure 5:
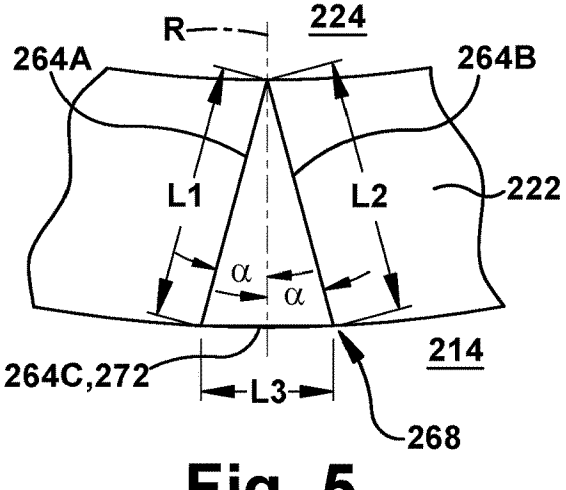
FIG. 5 shows a cross-sectional, top-down view of a vane, according to embodiments of the disclosure.
Figure 9:
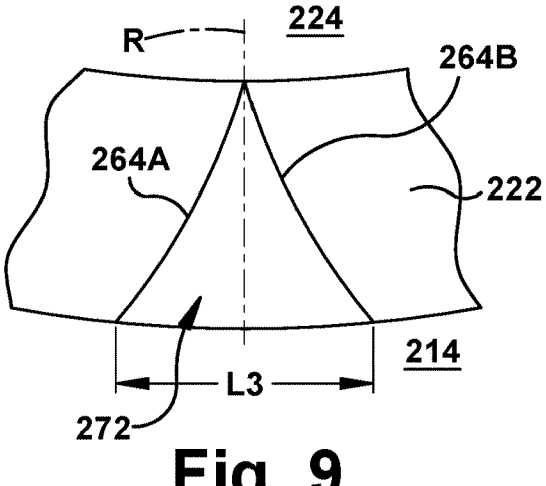
FIG. 9 shows a cross-sectional, top-down view of a vane, according to yet other embodiments of the disclosure.
Figure 8:
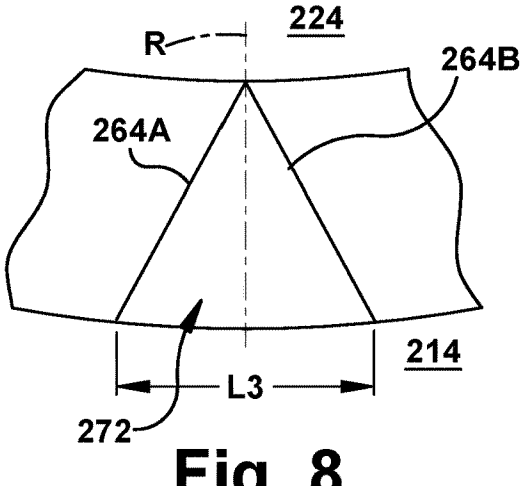
FIG. 8 shows a cross-sectional, top-down view of a vane, according to alternative embodiments of the disclosure.

In FIG. 5, vanes 260 may define an isosceles triangle 268 centered on a radius R of diverter member 240 and/or opening 224 (shown), i.e., with equal angles α. Here, plates 264A, 264B have the same lengths L1, L2, but a third plate 264C has a different length, L3. In FIG. 6, vanes 260 may define an equilateral triangle 270 centered on radius R of diverter member 240 and/or opening 224 (shown). Here, plates 264A-C all have the same lengths L1, L2, L3. Some curvature of plates 264 is also possible while still maintaining a radially diverging cross-section. For example, in FIG. 7, at least plates 264A, 264B may be curved (e.g., in a concave shape). Plate 264C in FIG. 7 can have any shape. FIGS. 8 and 9 show embodiments in which only two plates 264A, B are used to create a radially diverging cross-section of vanes 260. Plates 264A-B are planar in FIG. 8 and curved in FIG. 9. Where curved (FIGS. 7 and 9), plates 264A-B may have the same curvature or different curvatures, and the amount of curvature can be used defined. Plates 264 may be fixed in any manner to diverter member 240 and mounting member 220, e.g., welding, male-female connections, etc.

Any number of vanes 260 may be used. For example, in FIG. 2, twelve vanes 260 are illustrated. In FIGS. 5-9, length L3 indicates a length of a radial outer end 272 of each vane 260. As shown in FIG. 2, length L3 may be user defined to define an area A through which exhaust flows 262 exit from structure 210. Area A may be defined by vanes 260 to control a number of parameters including, for example, back pressure, additional exhaust flows' 262 radial exit velocity, exhaust flow 262 velocity uniformity across area A, and a noise profile of structure 210. In certain embodiments, vanes 260 (radially outer ends 272 thereof) collectively block a circumferential opening between adjacent vanes 260, diverter member 240 and mounting member 220 (i.e., base member 222) by approximately 25-45%. That is, a circumferential area between base 222 and cover 259 (around the perimeter) is 25-45% blocked by radial outer ends 272 of vanes 260. In certain embodiments, vanes 260 block between approximately 30-40%, and in another embodiment, they block approximately 35%. The reduction in area reduces noise. For example, structure 210 has a sound power level of less than 115 A-weighted decibels (dBA). Vanes 260 also reduce or eliminate any whistle noise (at the Strouhal frequency).

Figure 11:
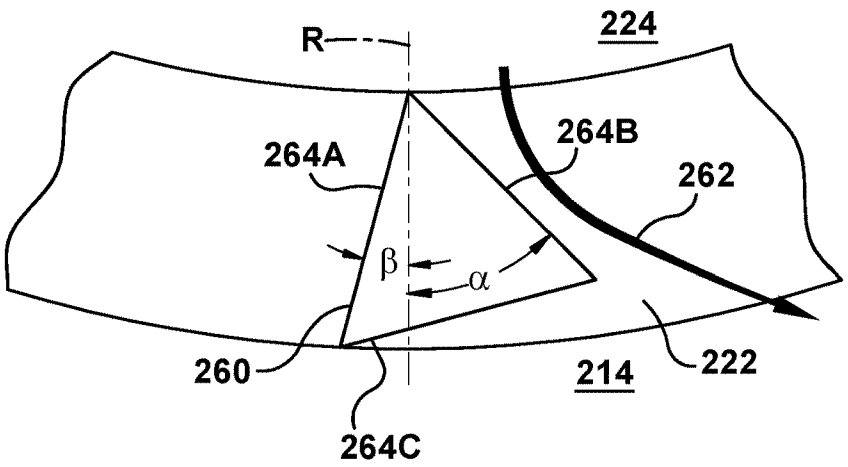
FIG. 11 shows a cross-sectional, top-down view of a vane illustrating angling options relative to a radius of the structure, according to embodiments of the disclosure.
Figure 10:
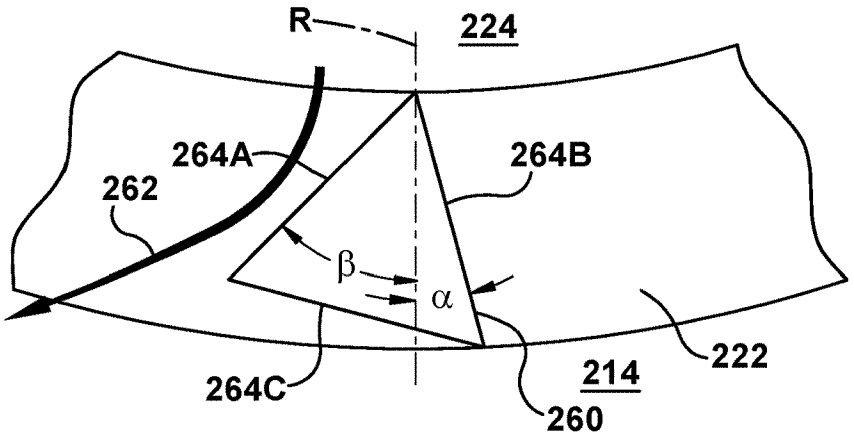
FIG. 10 shows a cross-sectional, top-down view of a vane illustrating angling options relative to a radius of the structure, according to embodiments of the disclosure.

In FIGS. 5-9, each vane 260 is shown centered with radius R of opening 224. However, FIGS. 10-11 show cross-sectional views of vane(s) 260 that are not centered with a radius R of diverter member 240 and/or opening 224. Here, angle β and angle α are not identical. Within an exemplary structure 210, vane(s) 260 are thus angled in the same direction relative to radius R and impart a rotation to exhaust flows 262. FIG. 10 shows an arrangement that imparts a clockwise rotation, and FIG. 11 shows an arrangement that imparts a counterclockwise rotation. The rotation may encourage mixing of exhaust flows 262 with ambient air in atmosphere 214 and may help exhaust flows 262 lose momentum and attain lower plume velocity.

The different structures listed for each embodiment can be interchanged amongst the embodiments, e.g., the frustoconical diverter member 240 in FIG. 3 can be used with the polygonal plate 228 of mounting member 220 in FIG. 2, among many other options.

Embodiments of structure 210 provide reduction of overall plume flow velocity (momentum) and/or temperature by mixing/diffusing initial exhaust flow 92 in the larger volume of surrounding ambient air, thereby controlling the plume rise, velocity, and buoyancy effects. Structure 210 can be customized to meet requirements for any desired governmental regulations, e.g., CASA regulations. For example, structure 210 can be customized to control a noise profile of the exhaust plume and/or plume vertical flow velocity. Advantageously, the single array of vanes 260 between base member 222 and cover member 259 reduces weight and cost of structure 110, as well as being less noisy, when compared with exhaust plume control structures having stacked arrays of vanes.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately" as applied to a particular value of a range applies to both end values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. An exhaust plume control structure, comprising:

a mounting member configured to mount to an exhaust flow source, the mounting member including a plate having an opening defined therein in fluid communication with the exhaust flow source;

a diverter member operatively coupled to the mounting member to radially direct an initial exhaust flow exiting from the exhaust flow source radially outward; and a plurality of peripherally spaced, radially extending vanes coupled to the mounting member and disposed radially outward of the diverter member, the plurality of peripherally spaced vanes positioned to separate the radially outward directed initial exhaust flow into a plurality of additional exhaust flows, each vane of the plurality of peripherally spaced vanes having a radially diverging cross-section having a first side extending at a first angle relative to a given radius of the diverter member and a second side extending at a second angle relative to the given radius of the diverter member, wherein the first angle and the second angle are not identical, wherein the diverter member extends into the opening of the plate to radially direct the initial exhaust flow from the exhaust flow source across each of the plurality of peripherally spaced vanes.

2. The exhaust plume control structure of claim 1, wherein the diverter member includes at least a section of a cone, the at least a section of the cone extending into opening, wherein an outer surface of the diverter member is positioned in a spaced relation relative to an inner edge of the opening.

3. The exhaust plume control structure of claim 2, wherein the at least the section of the cone includes a frustoconical member.

4. The exhaust plume control structure of claim 1, wherein the diverter member further includes a cover member enclosing an axial end thereof.

5. The exhaust plume control structure of claim 4, wherein a circumferential area between the mounting member and the cover member is 25-45% blocked by radial outer ends of the plurality of vanes.

6. The exhaust plume control structure of claim 1, wherein the radially diverging cross-section of each of the plurality of peripherally spaced vanes defines an isosceles triangle centered on a radius of the diverter member.

7. The exhaust plume control structure of claim 1, wherein the radially diverging cross-section of each of the plurality of peripherally spaced vanes defines an equilateral triangle centered on the radius of the diverter member.

8. The exhaust plume control structure of claim 1, wherein the mounting member includes a flow expansion member coupled to the plate and a mounting extension extending from the flow expansion member, the mounting extension configured for coupling to the exhaust flow source.

9. The exhaust plume control structure of claim 1, wherein the exhaust flow source includes an exhaust stack of a power generating plant.

10. A power generating plant, including:

a power generating system, the power generating system creating an initial exhaust flow;

a stack configured to direct the initial exhaust flow to atmosphere; and an exhaust plume control structure, including:

a mounting member configured to mount to the stack, the mounting member including a plate having an opening defined therein in fluid communication with the initial exhaust flow;

a diverter member operatively coupled to the mounting member to radially direct an initial exhaust flow exiting from the exhaust flow source radially outward; and a plurality of peripherally spaced, radially extending vanes coupled to the mounting member and disposed radially outward of the diverter member, the plurality of peripherally spaced vanes positioned to separate the radially outward directed initial exhaust flow into a plurality of additional exhaust flows, each vane of the plurality of peripherally spaced vanes having a radially diverging cross-section having a first side extending at a first angle relative to a given radius of the diverter member and a second side extending at a second angle relative to the given radius of the diverter member, wherein the first angle and the second angle are not identical, each of the plurality of additional exhaust flows having a same radial exit velocity, wherein the diverter member extends into the opening of the plate to radially direct the initial exhaust flow from the power generating system across each of the plurality of peripherally spaced vanes.

11. The power generating plant of claim 10, wherein the diverter member includes at least a section of a cone, the at least a section of the cone extending into the opening, wherein an outer surface of the diverter member is positioned in a spaced relation relative to an inner edge of the opening.

12. The power generating plant of claim 11, wherein the at least the section of the cone includes a frustoconical member.

13. The power generating plant of claim 10, wherein the plurality of peripherally spaced vanes includes twelve vanes.

14. The power generating plant of claim 10, wherein the radially diverging cross-section of each of the plurality of peripherally spaced vanes defines an isosceles triangle centered on a radius of the diverter member.

15. The power generating plant of claim 10, wherein the radially diverging cross-section of each of the plurality of peripherally spaced vanes defines an equilateral triangle centered on the radius of the diverter member.

16. The power generating plant of claim 10, wherein the mounting member includes a flow expansion member coupled to the plate and a mounting extension extending from the flow expansion member, the mounting extension configured for coupling to the exhaust flow source.

17. The power generating plant of claim 10, wherein the diverter member further includes a cover member enclosing an axial end thereof.

18. The power generating plant of claim 17, wherein a circumferential area between the mounting member and the cover member is 25-45% blocked by radial outer ends of the plurality of vanes.

19. The power generating plant of claim 16, wherein the diverter member extends into the flow expansion member.

20. The exhaust plume control structure of claim 8, wherein the diverter member extends into the flow expansion member.

* * * * *